US009634383B2

(12) United States Patent
Lundbom et al.

(10) Patent No.: US 9,634,383 B2
(45) Date of Patent: Apr. 25, 2017

(54) GALVANICALLY SEPARATED NON-INTERACTING ANTENNA SECTOR APPARATUS AND METHODS

(71) Applicant: Pulse Finland Oy, Kempele (FI)

(72) Inventors: Juha Lundbom, Kempele (FI); Petteri Annamaa, Oulunsalo (FI)

(73) Assignee: PULSE FINLAND OY (FI)

( * ) Notice: Subject to any disclaimer, the term of this patent is extended or adjusted under 35 U.S.C. 154(b) by 552 days.

(21) Appl. No.: 13/928,026

(22) Filed: Jun. 26, 2013

(65) Prior Publication Data

US 2015/0002338 A1 Jan. 1, 2015

(51) Int. Cl.

| | |
|---|---|
| ***H01Q 1/36*** | (2006.01) |
| ***H01Q 1/38*** | (2006.01) |
| ***H01Q 1/52*** | (2006.01) |

(52) U.S. Cl.

CPC ..... *H01Q 1/36* (2013.01); *H01Q 1/38* (2013.01); *H01Q 1/52* (2013.01); *H01Q 1/528* (2013.01); *Y10T 29/49016* (2015.01)

(58) Field of Classification Search

CPC ..... H01Q 1/36
USPC ..... 343/700 MS
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Dameon E Levi
*Assistant Examiner* — Walter Davis
(74) *Attorney, Agent, or Firm* — Gazdzinski & Associates, PC

(57) ABSTRACT

An antenna apparatus with isolated non-interactive sectors and methods operating and forming the same. In one embodiment, an antenna with a radiative element comprising a planar layer with multiple sectors is disclosed. The sectors are configured to be interactive or non-interactive. The interactive sectors contribute to the radiative profile of the antenna. The non-interactive sectors are galvanically isolated from the interactive sectors and do not substantially affect the radiative profile of the antenna. Region borders are present between various ones of the interacting and non-interacting sectors. These region borders provide the galvanic isolation between the interacting and non-interacting sectors. The antenna further includes feed portions coupled to the interactive sectors, thereby defining the antenna pattern. The non-interactive sectors are largely transparent to the radiative mode and thus do not substantially affect the antenna pattern.

22 Claims, 5 Drawing Sheets

(56) References Cited

U.S. PATENT DOCUMENTS 4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaisanen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.

(56) References Cited

U.S. PATENT DOCUMENTS 5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata et al.
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,218,989 B1 4/2001 Schneider et al.
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,112,108 A1 8/2002 Crowley et al.
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,065 B2 9/2005 Ying et al.
6,950,066 B2 9/2005 Hendler et al.
6,950,068 B2 9/2005 Bordi
6,950,072 B2 9/2005 Miyata et al.
6,952,144 B2 10/2005 Javor
6,952,187 B2 10/2005 Annamaa
6,958,730 B2 10/2005 Nagumo et al.

(56) References Cited

U.S. PATENT DOCUMENTS 6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,980,158 B2 12/2005 Iguchi et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,034,752 B2 4/2006 Sekiguchi et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,061,430 B2 6/2006 Zheng et al.
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,129,893 B2 10/2006 Otaka et al.
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,215,283 B2 5/2007 Boyle
7,218,280 B2 5/2007 Annamaa
7,218,282 B2 5/2007 Humpfer et al.
7,224,313 B2 5/2007 McKinzie, III et al.
7,230,574 B2 6/2007 Johnson
7,233,775 B2 6/2007 De Graauw
7,237,318 B2 7/2007 Annamaa
7,256,743 B2 8/2007 Korva
7,274,334 B2 9/2007 O'Riordan et al.
7,283,097 B2 10/2007 Wen et al.
7,289,064 B2 10/2007 Cheng
7,292,200 B2 11/2007 Posluszny et al.
7,319,432 B2 1/2008 Andersson
7,330,153 B2 2/2008 Rentz
7,333,067 B2 2/2008 Hung et al.
7,339,528 B2 3/2008 Wang et al.
7,340,286 B2 3/2008 Korva et al.
7,345,634 B2 3/2008 Ozkar et al.
7,352,326 B2 4/2008 Korva
7,355,270 B2 4/2008 Hasebe et al.
7,358,902 B2 4/2008 Erkocevic
7,375,695 B2 5/2008 Ishizuka et al.
7,381,774 B2 6/2008 Bish et al.
7,382,319 B2 6/2008 Kawahata et al.
7,385,556 B2 6/2008 Chung et al.
7,388,543 B2 6/2008 Vance
7,391,378 B2 6/2008 Mikkola
7,405,702 B2 7/2008 Annamaa et al.
7,417,588 B2 8/2008 Castany et al.
7,423,592 B2 9/2008 Pros et al.
7,432,860 B2 10/2008 Huynh
7,439,929 B2 10/2008 Ozkar
7,443,344 B2 10/2008 Boyle
7,468,700 B2 12/2008 Milosavlejevic
7,468,709 B2 12/2008 Niemi
7,498,990 B2 3/2009 Park et al.
7,501,983 B2 3/2009 Mikkola
7,502,598 B2 3/2009 Kronberger
7,564,413 B2 7/2009 Kim et al.
7,589,678 B2 9/2009 Perunka et al.
7,616,158 B2 11/2009 Mark et al.
7,633,449 B2 12/2009 Oh
7,663,551 B2 2/2010 Nissinen
7,679,565 B2 3/2010 Sorvala
7,692,543 B2 4/2010 Copeland
7,710,325 B2 5/2010 Cheng
7,724,204 B2 5/2010 Annamaa
7,760,146 B2 7/2010 Ollikainen
7,764,245 B2 7/2010 Loyet
7,786,938 B2 8/2010 Sorvala
7,800,544 B2 9/2010 Thornell-Pers
7,830,327 B2 11/2010 He
7,843,397 B2 11/2010 Boyle
7,847,753 B2 * 12/2010 Ishibashi ..... H01Q 1/243 343/702
7,889,139 B2 2/2011 Hobson et al.
7,889,143 B2 2/2011 Milosavljevic
7,901,617 B2 3/2011 Taylor
7,903,035 B2 3/2011 Mlkkola et al.
7,916,086 B2 3/2011 Koskiniemi et al.
7,963,347 B2 6/2011 Pabon
7,973,720 B2 7/2011 Sorvala
8,004,470 B2 * 8/2011 Sorvala ..... H01Q 1/243 343/700 MS
8,049,670 B2 11/2011 Jung et al.
8,054,232 B2 11/2011 Chiang et al.
8,098,202 B2 1/2012 Annamaa et al.
8,179,322 B2 5/2012 Nissinen
8,193,998 B2 6/2012 Puente Baliarda et al.
8,378,892 B2 2/2013 Sorvala
8,466,756 B2 6/2013 Milosavljevic et al.
8,473,017 B2 6/2013 Milosavljevic et al.
8,564,485 B2 10/2013 Milosavljevic et al.
8,629,813 B2 1/2014 Milosavljevic
2001/0050636 A1 12/2001 Weinberger
2002/0183013 A1 12/2002 Auckland et al.
2002/0196192 A1 12/2002 Nagumo et al.
2003/0146873 A1 8/2003 Blancho
2004/0090378 A1 5/2004 Dai et al.
2004/0137950 A1 7/2004 Bolin et al.
2004/0145525 A1 7/2004 Annabi et al.
2004/0171403 A1 9/2004 Mikkola
2005/0057401 A1 3/2005 Yuanzhu
2005/0159131 A1 7/2005 Shibagaki et al.
2005/0176481 A1 8/2005 Jeong
2006/0071857 A1 4/2006 Pelzer
2006/0192723 A1 8/2006 Harada
2007/0042615 A1 2/2007 Liao
2007/0082789 A1 4/2007 Nissila
2007/0152881 A1 7/2007 Chan
2007/0188388 A1 8/2007 Feng
2008/0055164 A1 3/2008 Zhang et al.
2008/0059106 A1 3/2008 Wight
2008/0088511 A1 4/2008 Sorvala
2008/0266199 A1 10/2008 Milosavljevic
2009/0009415 A1 1/2009 Tanska
2009/0135066 A1 * 5/2009 Raappana ..... H01Q 1/243 343/700 MS
2009/0153412 A1 6/2009 Chiang et al.
2009/0174604 A1 7/2009 Keskitalo
2009/0196160 A1 8/2009 Crombach
2009/0197654 A1 8/2009 Teshima
2009/0231213 A1 9/2009 Ishimiya
2010/0220016 A1 9/2010 Nissinen
2010/0244978 A1 9/2010 Milosavljevic
2010/0309092 A1 12/2010 Lambacka
2011/0084887 A1 * 4/2011 Mow ..... G01R 29/10 343/703
2011/0133994 A1 6/2011 Korva
2012/0119955 A1 5/2012 Milosavljevic et al.

FOREIGN PATENT DOCUMENTS

DE 10150149 4/2003
EP 0 208 424 1/1987
EP 0 376 643 4/1990
EP 0 751 043 4/1997
EP 0 807 988 11/1997

(56) References Cited

FOREIGN PATENT DOCUMENTS

| | | |
|---|---|---|
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its effect on planar inverted-F antennas (PIFAs) for mobile handsets," *IEEE Antennas and Wireless Propagation Letters,* vol. 2, 226-229, 2003.

C. R. Rowell and R. D. Murch, "A compact PIFA suitable for dual frequency 900/1800-MHz operation," *IEEE Trans. Antennas Propag.,* vol. 46, No. 4, pp. 596-598, Apr. 1998.

Chang-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EO 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.,* vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters,* vol. 3, 295-297, 2004.

Guo, Y. X. and Y.W. Chia and Z. N. Chen, "Miniature built-in quadband antennas for mobile handsets", *IEEE Antennas Wireless Propag. Lett.,* vol. 2, pp. 30-32, 2004.

Hoon Park, et al. "Design of an internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.,* vol. 16, No. 3, pp. 113-115-, Mar. 2006.

Hossa, R., A. Byndas, and M. E. Bialkowski, "Improvement of compact terminal antenna performance by incorporating open-end slots in ground plane," *IEEE Microwave and Wireless Components Letters,* vol. 14, 283-285, 2004.

I. Ang, Y. X. Guo, and Y. W. Chia, "Compact internal quad-band antenna for mobile phones" *Micro. Opt. Technol. Lett.,* vol. 38, No. 3 pp. 217-223 Aug. 2003.

International Preliminary Report on Patentability for International Application No. PCT/FI2004/000554, date of issuance of report May 1, 2006.

Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.

Kim, B. C., J. H. Yun, and H. D. Choi, "Small wideband PIFA for mobile phones at 1800 MHz," *IEEE International Conference on Vehicular Technology,* 27{29, Daejeon, South Korea, May 2004.

(56) References Cited

OTHER PUBLICATIONS

Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility,* vol. 46, 71{86, 2004.
K-L Wong, *Planar Antennas for Wireless Communications,* Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation,* vol. 54, 2226{2232, 2006.
Marta Martinez-Vazquez, et al., "Integrated Planar Multiband Antennas for Personal Communication Handsets", *IEEE Trasactions on Antennas and propagation,* vol. 54, No. 2, Feb. 2006.
P. Ciais, et al., "Compact Internal Multiband Antennas for Mobile and WLAN Standards", *Electronic Letters,* vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.,* vol. 14, No. 4, pp. 148-150, Apr. 2004.
P. Salonen, et al. "New slot configurations for dual-band planar inverted-F antenna," *Microwave Opt. Technol.,* vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.,* pp. 266-269, Salt Lake City, UT, USA.
Wang, F., Z. Du, Q. Wang, and K. Gong, "Enhanced-bandwidth PIFA with T-shaped ground plane," *Electronics Letters,* vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations;* Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

* cited by examiner

GALVANICALLY SEPARATED NON-INTERACTING ANTENNA SECTOR APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna apparatus for use in electronic devices such as wireless or portable radio devices, and more particularly in one exemplary aspect to an antenna with one or more substantially non-interacting antenna sectors.

DESCRIPTION OF RELATED TECHNOLOGY

Antennas are commonly found in most modern radio devices, such as mobile computers, mobile phones, Blackberry® devices, GPS or other navigation devices, smartphones, personal digital assistants (PDAs), or other personal communication devices (PCD). Often, these devices connect via one or more wireless data/voice technologies each requiring unique transmission characteristics. The device may reuse a single antenna over multiple air interface technologies, or may include multiple antennas, or both. Whether reused or multifold, these antennas must often facilitate the maintenance of radio connectivity over a variety of frequency ranges. Typically, these antennas comprise a radiating plane. However, in order to properly optimize the antenna for radiation/absorption at the proper frequency ranges, the shape of the radiating plane is constrained.

Furthermore, multiple antennas may need to be included in the device—each with a shape dictated by the transmission characteristics of its corresponding wireless technology. Generally, shape determinations are made independently of aesthetic concerns, because deviating from the optimal shape can be associated with a significant performance loss.

Typical prior art solutions often rely on visually obscuring the antenna to maintain aesthetic continuity, such as by disposing it within a housing or other component of the host device. However, material used to obscure the antenna (such as e.g., a metal housing component) may itself affect the performance of the antenna. Alternatively, significant deviations from the optimal shape are made, leading to undesirable effects.

Accordingly, there is a salient need for, inter alia, an improved antenna solution that allows for flexibility is aesthetic design without requiring significant performance tradeoffs.

SUMMARY OF THE DISCLOSURE

The present disclosure satisfies the foregoing needs by providing, inter alia, an antenna apparatus with one or more non-interactive regions and methods of tuning and use.

In a first aspect, an antenna is disclosed. In one embodiment, the antenna includes: (i) a planar radiative layer, and (ii) one or more region borders. The planar radiative layer includes: (i) one or more active regions, (ii) at least one substantially inactive region. The one or more region borders are configured to galvanically isolate the at least one inactive region from the one or more active regions.

In a variant, the at least one substantially inactive region and the one or more active regions are formed from one or more materials with similar appearances.

In a second aspect of the disclosure, a method of forming an aesthetically optimized antenna is disclosed. In one embodiment, the method includes: (i) forming a radiating plane comprising a plurality of sectors, (ii) galvanically isolating each of the plurality of sectors, and (iii) forming one or more feeds.

In one variant, the plurality of sectors include one or more first sectors and one or more second sectors, the first sectors characterized by a dimension below a predetermined threshold, the second sectors characterized by the dimension above the predetermined threshold. Further, the method includes: configuring the antenna to radiate with a resonance pattern by (i) coupling the one or more feeds to the second sectors and (ii) galvanically isolating the first sectors from the one or more feeds.

In a third aspect of the disclosure, a method of tuning an antenna (e.g., to a desired resonance) is disclosed. In one embodiment, the method includes: (i) applying a signal to at least one feed, (ii) propagating the applied signal via one or more active sectors in electrical communication with the at least one feed, and (iii) propagating the applied signal through one or more inactive sectors, the inactive sectors being electrically isolated from the at least one feed and the active sectors.

In one variant, the one or more inactive sectors are configured to: (i) address one or more aesthetic aspects of the antenna, and (ii) leave a propagation mode of the antenna substantially unaffected.

In a fourth aspect of the disclosure, a method of operating an antenna apparatus is disclosed.

In a fifth aspect of the disclosure, a method of tuning an antenna apparatus to a resonance is disclosed.

In a sixth aspect of the disclosure, a method of operating, inter alia, a mobile device is disclosed.

Further features of the present disclosure, its nature and various advantages will be more apparent from the accompanying drawings and the following detailed description.

BRIEF DESCRIPTION OF THE DRAWINGS

The features, objectives, and advantages of the various embodiments and aspects of the disclosure will become more apparent from the detailed description set forth below when taken in conjunction with the drawings, wherein.

Figure 1:
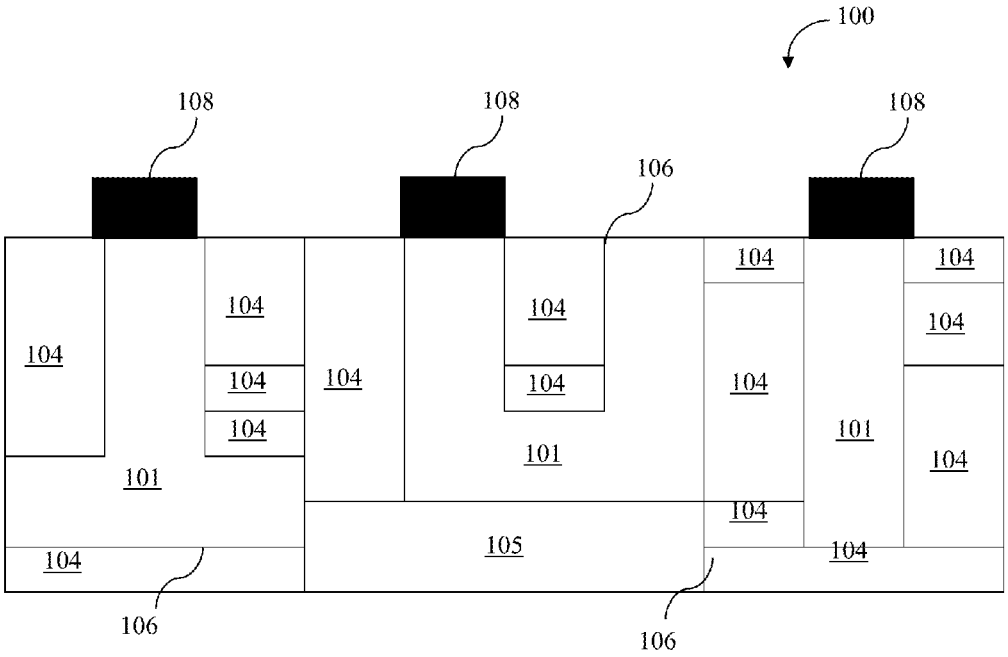
FIG. 1 is a functional diagram detailing an exemplary configuration of an antenna with one or more non-interactive regions consistent with the present disclosure.

All Figures disclosed herein are © Copyright 2012-2013 Pulse Finland Oy. All rights reserved.

DETAILED DESCRIPTION OF THE EMBODIMENTS

Reference is now made to the drawings wherein like numerals refer to like parts throughout.

As used herein, the terms "antenna," "antenna system," "antenna assembly", and "multiband antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet/phablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, NFC/RFID, Zigbee, satellite systems such as GPS, millimeter wave or microwave systems, optical, acoustic, and infrared (i.e., IrDA).

Overview

The present disclosure addresses the above-discussed needs by, in one exemplary embodiment, providing techniques and apparatus for non-interactive regions disposed on a radiative plane of an antenna. In the exemplary implementation, the antenna includes a one or more active regions and a plurality of non-interactive regions. The non-interactive regions provide flexibility in the selection of the overall aesthetic mode of the antenna. This is achieved by substantially decoupling the radiative profile of the antenna with its physical layout and appearance. The non-interactive regions are configured so as to avoid coupling with the radiative models) of the antenna. For example, in various implementations, the size (e.g. area, volume, length of major axes, etc.) of the non-interactive regions is selected such that they are largely transparent to the radiated mode of the antenna. Thus, the non-interactive regions may be placed with limited concern as to whether the radiative profile of the antenna is altered.

The active regions define the antenna pattern, and are coupled to feeds that supply (or accept) the signal transmitted (received) by the antenna. In various embodiments, the active and non-interactive regions are electrically isolated from one another. In one variant, the isolation is achieved by one or more insulating borders placed between the various regions.

The non-interactive regions may also be used to obscure the actual pattern of the antenna. For example, if the non-interactive regions are fashioned from a material similar in appearance (or the same material) to that of the active region, attempts to discern the pattern of the antenna by visual inspection may be frustrated. This may be useful, inter alia, in situations in which the antenna pattern conflicts with one or more aesthetic design aspects of a host (e.g., mobile) device.

DETAILED DESCRIPTION OF EXEMPLARY EMBODIMENTS

Detailed descriptions of the various embodiments and variants of the apparatus and methods of the disclosure are now provided. While primarily discussed in the context of wireless mobile devices, the various apparatus and methodologies discussed herein are not so limited. In fact, many of the apparatus and methodologies described herein are useful in any number of complex antennas, whether associated with mobile or fixed devices that can benefit from substantially non-interacting sector antenna methodologies and apparatus described herein.

Further, the exemplary techniques and architectures presented herein are discussed in terms of an antenna including a radiative plane or layer. However, other antenna configurations may be substituted. The principles described herein may be used with virtually any antenna configuration wherein the appearance or physical layout of antenna is not defined or fully defined by its radiative profile.

Exemplary Antenna Apparatus

The present disclosure provides, in one salient aspect, an antenna apparatus including a radiating element with one or more substantially non-interacting sectors and methods of forming and operating the same. Specifically, in one embodiment, the aesthetic design tolerances of an antenna component in an electrical device are increased, without proportional tradeoffs in antenna performance. Thereby, the embodiment allows for increased aesthetic continuity in spatially compact host devices such as smartphones, tablets, phablets, and the like.

Referring now to FIG. 1, an exemplary embodiment 100 of the antenna radiative element is shown. The radiative element comprises a planar layer fashioned from a single material. The antenna may be configured to operate at various microwave or radio frequencies (e.g. 100 kHz-1 THz). In some embodiments, cellular and wireless communication bands are used (e.g. 800 MHz, 900 MHz, 1.9 GHz, 2.1 GHz, 2.4 GHz, or 5 GHz, etc.). Further, the antenna may be configured for multiband operation and configured to resonate at multiple frequencies. The planar layer is divided into sectors (101, 104, 105), which may vary in size and shape. The sectors may be configured to be interactive 101 or non-interactive 104, 105. The interactive sectors contribute to the radiative profile of the antenna. The non-interactive sectors are galvanically isolated from the interactive sectors and do not substantially affect the radiative profile of the antenna.

In some implementations, the non-interactive sectors have one or more dimensions below a predetermined threshold to minimize the effect of the non-interactive sector on the radiative profile of the antenna.

In some variants, the non-interactive sectors include a rectangular area on the planar layer with a length dimension less than a fraction of a wavelength of the highest frequency in the operative band(s) of the antenna. For example, length of the sectors may be constrained to a quarter of the wavelength or one-twentieth of the wavelength. It will be appreciated that for an arbitrarily shaped area, the constraint may apply to a maximum diameter or other defining dimension of the sector. Moreover, the size constraint may vary depending on the medium of propagation. For example, a wave traveling within a copper medium will have its size thresholds scaled by the index of copper (for a given frequency). Similarly, a wave traveling in free-space will have larger size thresholds given the relevant index of one for free-space.

Referring again to the embodiment 100 of FIG. 1, it can be seen that region borders 106 are present between various ones of the interacting and non-interacting sectors. These region borders may be configured to provide the galvanic isolation between the interacting and non-interacting sectors discussed above. In various implementations, the isolation may be provided by various electrically insulating materials such as polyethylene terephthalate (PET), polyethylene naphthalate (PEN), polyimide (PI), polycarbonate (PC), glass, etc., or by air gaps at the region borders.

The borders 106 are visibly distinct in the embodiment of FIG. 1. However, in other embodiments, the borders may comprise materials visibly similar or even identical to the material of the interacting sectors. The visibly similar material may be configured to provide the galvanic isolation, as is the case with visibly distinct borders. Thus, the visibly similar borders further obscure the layout of the antenna, while still providing functionality. The visibly similar material may be an insulating material with the same color/texture as that of the material making up the sectors. Further, visibly similar material may be a different state of the same material making up other portions of the antenna. For example, the material may be a non-conductive mesh coated in a conducting compound, and the visibly similar material may be the mesh with the compound removed.

The feeds 108 connect one or more of the interacting portions of the radiative planar element to the drive elements of the antenna allowing operation. It will be appreciated that various ones of the interactive regions 101 may galvanically isolated from each other. Further, some embodiments comprise interactive regions isolated from other such regions and the feeds (not shown). These isolated interactive regions affect the radiative profile by coupling to the radiated mode of the other interactive regions, thereby altering the final mode (e.g. frequency resonance, spatial profile, directivity, etc.) propagated by the antenna. In some variants, an isolated interactive region may include a region with a dimension longer than the wavelengths of one or more of the operative bands of the antenna. For example, an isolated interactive region may have a dimension corresponding to a multiple of a wavelength of a frequency in one of the operating bands of the antenna.

Figure 1A:
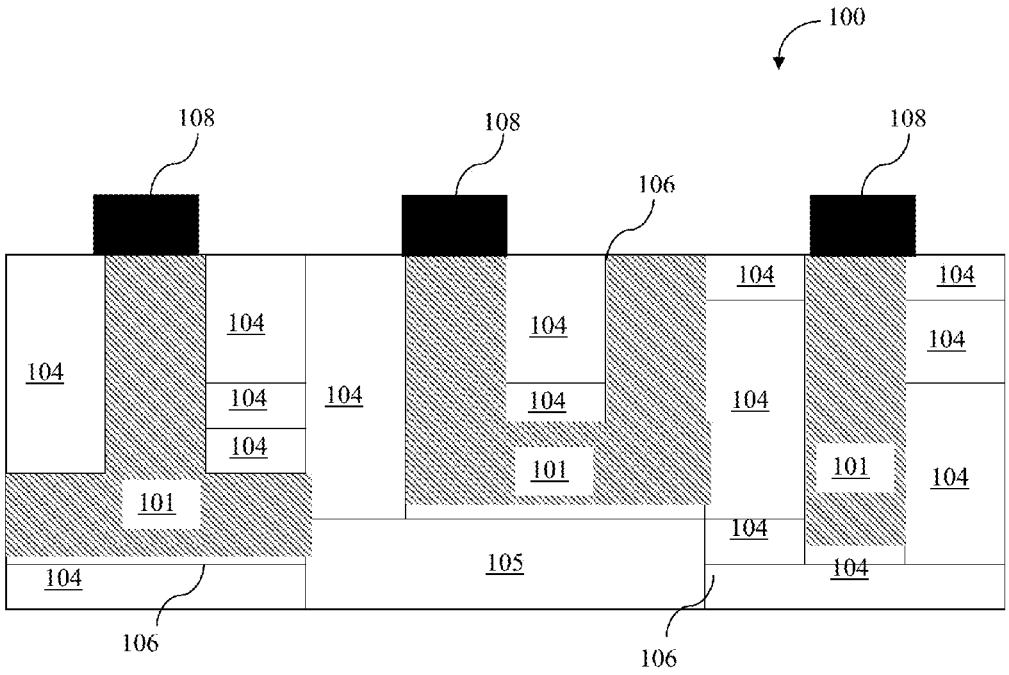
FIG. 1*a* is a functional diagram of the exemplary configuration of FIG. 1 with the antenna pattern highlighted for contrast.

Referring now to FIG. 1*a*, the exemplary embodiment of the apparatus 100 of FIG. 1 is shown, with the actual antenna pattern darkened for contrast. It should be noted that the darken areas are shown as such to elucidate the antenna pattern, but are not intend to suggest or require a particular appearance of the antenna. The non-interactive 104, 105 sectors provide the antenna with a regular rectangular appearance despite the actual pattern of the antenna being irregular. From FIG. 1*a*, it can be seen that non-interacting sectors 105 may be larger in area than one or more of the interactive sectors. Non-interacting sectors above a given size threshold for interactivity may be sliced into smaller sub-sectors. Each of the smaller sub-sectors may itself be divided until no single contiguous region above the size threshold comprises a single sector. Thus, non-interacting regions of arbitrary size may be created from a conglomerate of sectors.

Methods

Figure 2:
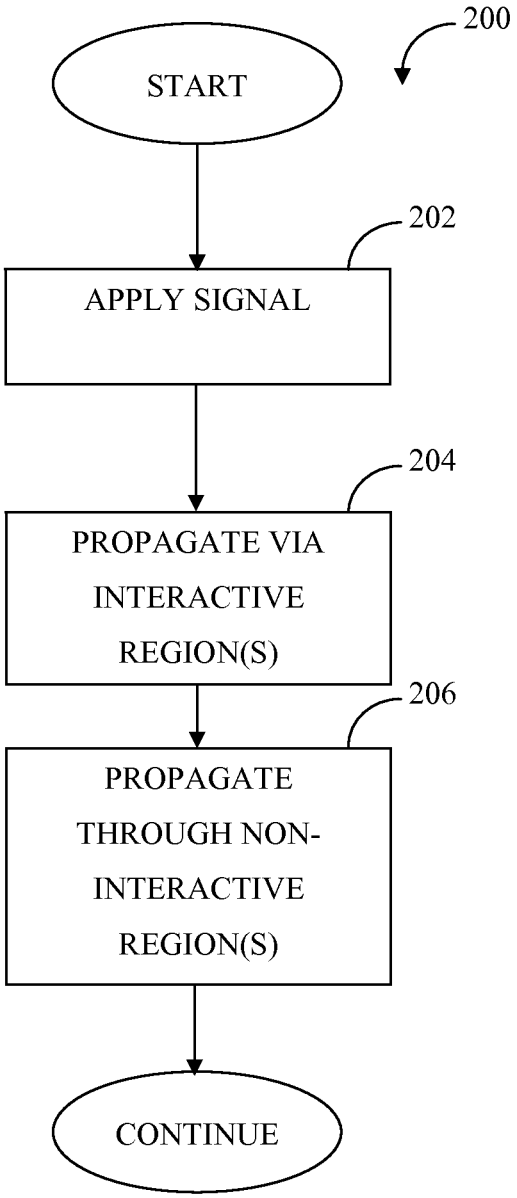
FIG. 2 is a logical flow diagram depicting a generalized method for tuning an antenna consistent with the present disclosure.

Referring now to FIG. 2, one embodiment of a generalized method 200 of tuning an antenna to a resonance mode is depicted in a logical flow diagram. At step 202 of the method 200, a signal is applied to a feed structure for the radiating plane of the antenna. The signal may include, without limitation, virtually any signal configured for propagation from a radio antenna (e.g. encoded data signals, digital or analog communications signals, voice calls, video calls, broadcasts, etc.).

At step 204, the applied signal is propagated using one or more of the interactive regions 101. The interactive regions are in signal communication with the antenna feeds. In various implementations, this communication is achieved through direct electrical contact; however in other implementations, other methods of coupling may be used between the feeds and interactive regions (e.g. inductive or capacitive techniques, etc.). The interactive regions define the radiative mode of the applied signal.

At step 206, the radiated mode propagates through one or more of the non-interactive regions 104 disposed proximate to the interactive regions 101. The non-interactive regions are configured to leave the propagating mode substantially unaffected. In various embodiments, this is achieved by configuring the non-interactive regions such that they do not couple to the radiated mode from the interactive regions. For example, as discussed above, the non-interactive regions may be broken into smaller isolated sub-sectors that are below a given size threshold. Thus, the non-interactive regions suffice to change the appearance and layout of the antenna without altering the propagated mode defined by the interactive regions.

Figure 3:
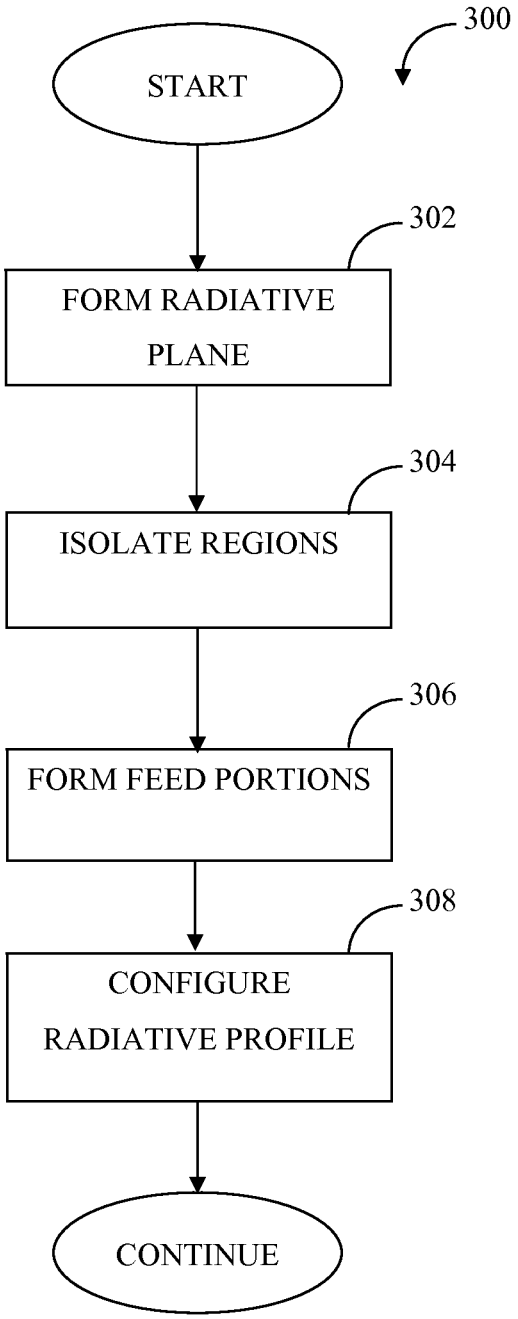
FIG. 3 is a logical flow diagram illustrating a generalized method of forming an antenna with one or more non-interactive regions consistent with the present disclosure.

Referring now to FIG. 3, one embodiment of a generalized method 300 of fabricating an antenna is illustrated in a logical flow diagram. At step 302, the method 300 includes forming a radiative plane with multiple regions. The region may interactive or non-interactive. The two types of regions are in one variant fabricated from materials with similar appearances, so as to maintain aesthetic continuity throughout the antenna. The interactive sections are formed such that they couple with the radiative mode of the antenna and define the antenna's radiative profile. The non-interactive sections are formed such that they do not substantially couple with radiative mode of the antenna.

In various embodiments, forming the regions such that they do not couple includes ensuring the non-interactive regions are below a predetermined size threshold (e.g. volume, area, largest dimension, dimension in the direction of propagation, etc.). It will be appreciated that such non-interactive regions may adjacent (or otherwise proximate) to other such non-interacting sections, such that a contiguous non-interactive region larger that the size threshold may be formed. The interactive and non-interactive regions may be formed out of materials that are similar in appearance. In some embodiments, the regions (whether interactive or non-interactive) are formed out of the same material. The material used in fabrication of the non-interactive regions may affect the size threshold necessary for non-interaction. In some cases, the selection of material may eliminate a need for any such threshold.

At step 304, the various regions are galvanically isolated from one another. A discussed above, the galvanic isolation may be achieved through e.g., the use of the insulating region borders 106. The borders themselves may be fabricated out of materials similar in appearance to that of the regions. Thus, the physical appearance of the antenna may be substantially independent of the radiative mode.

At step 306, feed portions of the antenna are formed. The feed portions may be formed out of any of a host of materials such that signals may be reliably passed to the active regions of the antenna.

At step 308, the antenna is configured for a particular radiative profile by coupling the feed portions to the interactive regions of the antenna. The coupling between the feed portions and the interactive regions defines the propagated mode of the antenna. In some embodiments, the coupling is achieved by placing the feeds in direct electrical communication with the interactive regions. In other embodiments, the coupling is achieved indirectly through capacitive or inductive techniques.

Example Operation

Figure 4:
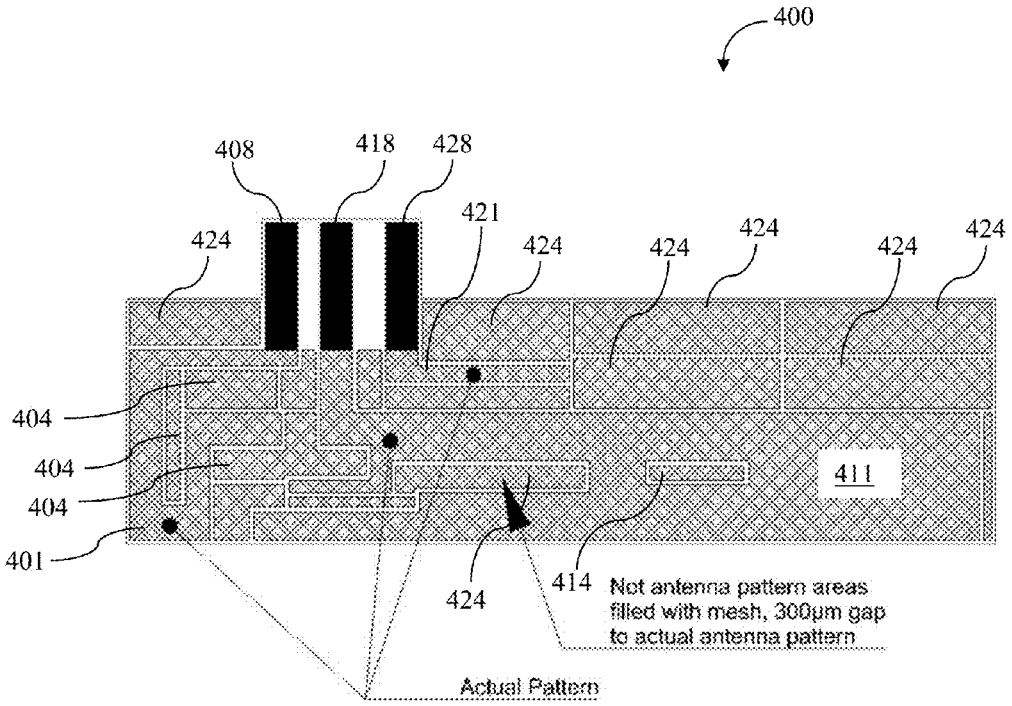
FIG. 4 is a planar view of an exemplary embodiment of an antenna with multiple interactive and multiple non-interactive regions consistent with the present disclosure.

Referring now to FIG. 4 an exemplary antenna 400 with interactive 401, 411, 421 and non-interactive regions 404, 414, 424 in its radiative plane is shown. The feeds 408, 418, 428 are in direct electrical contact with the interactive regions. The antenna is configured to operate as a tri-band digital cellular antenna at 800 MHz, 1.9 GHz, and 2.1 GHz.

The inter-region borders of this embodiment are composed of an insulating polymer material. The polymer material also serves to physically hold together the pieces that make up the radiative plane.

The regions (both interactive and non-interactive) are composed of a copper (Cu) mesh with 12-μm square-shaped holes. The holes a placed in a diamond pattern (e.g., the squares are 12 μm from a corner its opposite (i.e., 8.49-μm sides)).

The non-interactive region 414 is an example of a non-interactive region which is too small to couple to any of the radiative modes of the antenna. The region merely exists as a 100-μm×30-μm gap in the actual pattern of the antenna.

The non-interactive regions 424 are examples are regions that are large enough to couple to the radiative modes of the antenna. These regions have the potential to disturb the modes at 1.9 GHz and 2.1 GHz, in particular. For clarity, these regions are shown without internal borders (so as to demarcate their full extent); however, these regions are in the illustrated embodiment broken up into small sub-regions such that they do not disturb the modes of the antenna at any of the operational frequencies.

The interactive regions 401, 411, 421 are respectively connected to the feeds 408, 418, 428 and define the output mode of the antenna. The interactive are configured to radiate according signals applied to the feeds (e.g. from a mobile wireless device).

It will be recognized that while certain aspects of the disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed implementations, or the order of performance of two or more steps permuted. All such variations are considered to be encompassed within the disclosure disclosed and claimed herein.

While the above detailed description has shown, described, and pointed out novel features of the disclosure as applied to various implementations, it will be understood that various omissions, substitutions, and changes in the form and details of the device or process illustrated may be made by those skilled in the art without departing from the disclosure. The foregoing description is of the best mode presently contemplated of carrying out the disclosure. This description is in no way meant to be limiting, but rather should be taken as illustrative of the general principles of the disclosure. The scope of the disclosure should be determined with reference to the claims.

What is claimed is:

1. An antenna comprising:

a planar radiative layer comprising:

one or more active regions configured to contribute to a radiative profile of the antenna;

at least one substantially inactive region that does not contribute to the radiative profile of the antenna; and one or more region borders configured to galvanically isolate the at least one inactive region from the one or more active regions, wherein the one or more active regions and the at least one substantially inactive region are disposed such that they are coplanar with one another on the planar radiative layer for the antenna.

2. The antenna of claim 1, wherein the at least one substantially inactive region and the one or more active regions are formed from one or more materials with identical appearances.

3. The antenna of claim 2, wherein the one or more materials with identical appearances comprise only a single material.

4. The antenna of claim 2, wherein the one or more materials with identical appearances comprise at least two materials of a single color.

5. The antenna of claim 1, wherein the borders comprise an insulating polymer material.

6. The antenna of claim 2, wherein the borders comprise a substance with an appearance identical to the one or more materials with identical appearances.

7. The antenna of claim 1, wherein the at least one substantially inactive region comprises at least one dimension below a predetermined threshold.

8. The antenna of claim 1, further comprising one or more feeds coupled to the one or more active regions.

9. A method of forming an antenna, the method comprising:

forming a radiating plane, the radiating plane comprising a plurality of sectors, the plurality of sectors comprising one or more first conductive sectors and one or more second conductive sectors, the first conductive sectors comprising a first dimension below a predetermined size threshold, the second conductive sectors comprising a second dimension above the predetermined size threshold;

galvanically isolating each of the plurality of sectors;

forming one or more feeds; and configuring the antenna to radiate with a resonance pattern by (i) coupling the one or more feeds to the second sectors and (ii) galvanically isolating the first sectors from the one or more feeds;

wherein the first conductive sectors comprise the first dimension below the predetermined size threshold and are configured to be inactive with respect to a radiative profile of the antenna; and wherein the second conductive sectors comprise the second dimension above the predetermined size threshold and are configured to be active with respect to the radiative profile of the antenna.

10. The method of claim 9, wherein continuity with respect to at least one aesthetic feature or aspect is maintained in the antenna such that the first and second sectors are respectively formed from first and second materials, the first and second materials comprising materials that are identical in appearance to one another.

11. The method of claim 10, wherein the first and second materials comprises an identical material.

12. The method of claim 9, wherein the one or more second sectors comprise adjacent sectors so as to form a region characterized by a third dimension above the predetermined size threshold.

13. The method of claim 9, wherein the galvanic isolation of each of the plurality of sectors comprises forming an insulating border between each adjacent sector.

14. The method of claim 9, wherein the coupling of the one or more feeds to the second sectors comprises one or more of (i) direct electrical coupling, (ii) capacitive coupling, and (iii) inductive coupling.

15. A method of tuning an antenna to a resonance, the method comprising:

applying a signal to at least one feed;

propagating the applied signal via one or more active sectors in electrical communication with the at least one feed; and propagating the applied signal through one or more inactive sectors, the inactive sectors electrically isolated from the at least one feed and the active sectors;

wherein the one or more inactive sectors are configured to:

comply with one or more aesthetic requirements of the antenna characterized by a material identical in appearance to the one or more active sectors; and leave a propagation mode of the antenna substantially unaffected.

16. The method claim 15, wherein the inactive sectors are fabricated from a first material identical in appearance to a second material of fabrication of the active sectors.

17. The method of claim 16, wherein the first and second materials comprise only a single material.

18. The method of claim 15, wherein polymer borders facilitate the electrical isolation of the inactive sectors from the at least one feed and the active sectors.

19. The method of claim 15, wherein the complying with the one or more aesthetic requirements comprises obscuring a layout of the antenna.

20. The method claim 15, wherein the complying with the one or more aesthetic requirements comprises providing the antenna with a regular shape.

21. The method claim 20, wherein the regular shape comprises a rectangular shape.

22. The antenna of claim 1, wherein:

the one or more active regions comprises a non-conductive mesh coated in a conducting compound; and the at least one substantially inactive region comprises the non-conductive mesh not coated in the conducting compound.

* * * * *